US012225962B1

(12) United States Patent
Goldston et al.

(10) Patent No.: US 12,225,962 B1
(45) Date of Patent: Feb. 18, 2025

(54) FOOTWEAR WITH FULL-LENGTH MIDSOLE AND HOLLOW CUPSOLE

(71) Applicant: Athletic Propulsion Labs LLC, Los Angeles, CA (US)

(72) Inventors: Mark R. Goldston, Beverly Hills, CA (US); Adam Goldston, Los Angeles, CA (US); Ryan Goldston, Los Angeles, CA (US); Cody Harris, Monrovia, CA (US)

(73) Assignee: Athletic Propulsion Labs LLC, Los Angeles, CA (US)

( * ) Notice: Subject to any disclaimer, the term of this patent is extended or adjusted under 35 U.S.C. 154(b) by 0 days.

(21) Appl. No.: 18/792,490

(22) Filed: Aug. 1, 2024

Related U.S. Application Data

(63) Continuation of application No. 18/634,838, filed on Apr. 12, 2024, now Pat. No. 12,089,689.

(51) Int. Cl.
*A43B 13/12* (2006.01)
*A43B 13/04* (2006.01)
*A43B 13/14* (2006.01)

(52) U.S. Cl.
CPC ..... *A43B 13/125* (2013.01); *A43B 13/04* (2013.01); *A43B 13/12* (2013.01); *A43B 13/141* (2013.01)

(58) Field of Classification Search
CPC ..... A43B 13/125; A43B 13/12; A43B 13/127
USPC ..... 36/25 R, 30 R
See application file for complete search history.

(56) References Cited

U.S. PATENT DOCUMENTS

| | | | | |
|---|---|---|---|---|
| 4,399,620 | A | 8/1983 | Funck | |
| 4,663,865 | A * | 5/1987 | Telecemian | A43B 13/181 36/114 |
| 4,858,340 | A | 8/1989 | Pasternak | |
| 5,042,174 | A * | 8/1991 | Nichols | A43B 13/14 36/31 |
| 5,741,568 | A | 4/1998 | Rudy | |
| 5,758,435 | A | 6/1998 | Miyata | |
| 5,979,081 | A | 11/1999 | Vaz | |
| 6,354,020 | B1 | 3/2002 | Kimball et al. | |
| 6,718,657 | B2 | 4/2004 | Chen | |
| 9,049,900 | B1 * | 6/2015 | Cox | A43B 1/0027 |

(Continued)

OTHER PUBLICATIONS

Non-Final Office Action on U.S. Appl. No. 18/634,838 DTD Jun. 3, 2024.

(Continued)

*Primary Examiner* — Marie D Bays
(74) *Attorney, Agent, or Firm* — Foley & Lardner LLP

(57) ABSTRACT

A footwear can include an outsole, a cupsole, a midsole, and an upper. The cupsole can include an inner surface and a lateral wall that forms a first receptacle. The cupsole can be composed of a first flexible material. The midsole can be arranged within the first receptacle of the cupsole. The midsole can be composed of a second flexible material. The midsole can include a top surface and a bottom surface. A portion of the lateral wall of the cupsole can extend beyond the top surface of the midsole when the midsole is arranged within the first receptacle of the cupsole and form a second receptacle. The upper can include a bottom plate coupled to the top surface of the midsole. A bottom portion of the upper can include the bottom plate of the upper and be arranged within the second receptacle.

24 Claims, 9 Drawing Sheets

(56) References Cited

U.S. PATENT DOCUMENTS

| | | | | |
|---|---|---|---|---|
| 2002/0050079 | A1* | 5/2002 | Yoshiaki | A43B 19/005 36/132 |
| 2002/0178612 | A1 | 12/2002 | Tsen et al. | |
| 2003/0101620 | A1* | 6/2003 | Reed | A43B 13/42 36/43 |
| 2010/0236098 | A1* | 9/2010 | Morgan | A43B 7/144 12/146 B |
| 2013/0019505 | A1* | 1/2013 | Borel | A43B 13/127 36/103 |
| 2013/0081305 | A1* | 4/2013 | Byrne | A43B 13/181 36/31 |
| 2017/0340053 | A1 | 11/2017 | Madore | |
| 2018/0153252 | A1* | 6/2018 | Archer | A43B 9/18 |
| 2018/0333921 | A1* | 11/2018 | Hender | A43B 13/20 |
| 2019/0365035 | A1* | 12/2019 | Jenkins | A43B 13/12 |
| 2020/0305541 | A1* | 10/2020 | Yahata | A43B 13/127 |
| 2020/0305545 | A1* | 10/2020 | Yahata | A43B 7/1435 |
| 2021/0204651 | A1 | 7/2021 | Thompson et al. | |
| 2021/0259367 | A1* | 8/2021 | Ekstrom | A43B 13/223 |
| 2021/0401117 | A1* | 12/2021 | Tanabe | B29C 44/42 |
| 2022/0055265 | A1* | 2/2022 | Gutmann | C08J 9/228 |

OTHER PUBLICATIONS

What is Supercritical EVA Material? Mar. 11, 2023, 7 page. Retrieved from: https://www.shunhogroup.com.hk/what-is-supercritical-eva-material.

* cited by examiner

FOOTWEAR WITH FULL-LENGTH MIDSOLE AND HOLLOW CUPSOLE

CROSS-REFERENCE

This application is a continuation of U.S. patent application Ser. No. 18/634,838, filed Apr. 12, 2024, which is related to U.S. Design application Ser. No. 29/937,274, filed Apr. 12, 2024, the entire content each is incorporated herein by reference in its entirety.

TECHNICAL FIELD

The present disclosure relates generally to footwear, and in particular, to footwear with full-length midsole and hollow cupsole.

BACKGROUND

Activities performed on hard surfaces (e.g., tennis, pickleball) exert force on a foot of a player. For example, the force can be exerted on the foot of the player when running, jumping, and/or stepping. Suitable footwear can mitigate the force exerted on the foot of the player, thus reducing the risk of injuries and improving comfort.

SUMMARY

The footwear described herein can mitigate and absorb force exerted on the feet of a wearer. The footwear can include a hollowed cupsole that includes an inner surface and a lateral wall. The inner surface and the lateral wall of the cupsole form a first receptacle. The cupsole is coupled to the outsole. A midsole can be arranged within the first receptacle and can have a length equal to a length of the first receptacle. The length of the cupsole can be a length of the cupsole along at least one of a last center line, a profile center line, and a heel center line. The midsole can absorb the force exerted on the foot by a surface and provide uniform energy return and cushioning to the foot. The cupsole is composed of a flexible or resilient material to allow the cupsole to deform in response to any force and allow for a greater absorption of force by the cupsole and the overall footwear. A combination of the midsole and the cupsole can provide the player with comfort and alleviate pressure when performing activities.

A footwear in accordance with some arrangements can include an outsole. The footwear can include a cupsole coupled to the outsole. The cupsole can include an inner surface and a lateral wall that can form a first receptacle. The cupsole can be composed of a first flexible material. The footwear can include a midsole arranged within the first receptacle of the cupsole. The midsole can be composed of a second flexible material. The midsole can include a top surface and a bottom surface. A portion of the lateral wall of the cupsole can extend beyond the top surface of the midsole when the midsole is arranged within the first receptacle of the cupsole. The portion of the lateral wall of the cupsole and the top surface of the midsole can form a second receptacle. The footwear can include an upper. The upper can include a bottom plate coupled to the top surface of the midsole. A bottom portion of the upper can include the bottom plate of the upper and can be arranged within the second receptacle.

In some arrangements, the first flexible material and the second flexible material are different flexible materials. The first flexible material can have a first durometer. The second flexible material can have a second durometer. The first durometer and the second durometer can be different.

In some arrangements, the midsole can extend to an entire length of the first receptacle. The midsole can include a first portion that can be located at a back of the cupsole and a second portion that can be located at a front of the cupsole. The portion of the lateral wall of the cupsole that extends beyond the top surface of the midsole can have a first thickness at the first portion of the midsole and a second thickness at the second portion of the midsole. The first thickness can be less than the second thickness.

In some arrangements, the midsole can be coupled to the inner surface of the cupsole via an adhesive. The midsole can be coupled to the inner surface and the lateral wall of the cupsole via an adhesive. The cupsole can flex in lateral directions perpendicular to at least one of the top surface of the midsole, the bottom surface of the midsole, the inner surface of the cupsole, or the bottom plate of the upper upon compression of the midsole by a force.

In some arrangements, the first flexible material can include an elastomer. The first flexible material can include rubber. The second flexible material can include a supercritical material. The second flexible material can include a gas-infused elastomer. The second flexible material can include a foam.

BRIEF DESCRIPTION OF DRAWINGS

The foregoing and other features of the present disclosure will become more fully apparent from the following description and appended claims, taken in conjunction with the accompanying drawings. Understanding that these drawings depict only several implementations in accordance with the disclosure and are, therefore, not to be considered limiting of its scope, the disclosure will be described with additional specificity and detail through use of the accompanying drawings.

Figure 1:
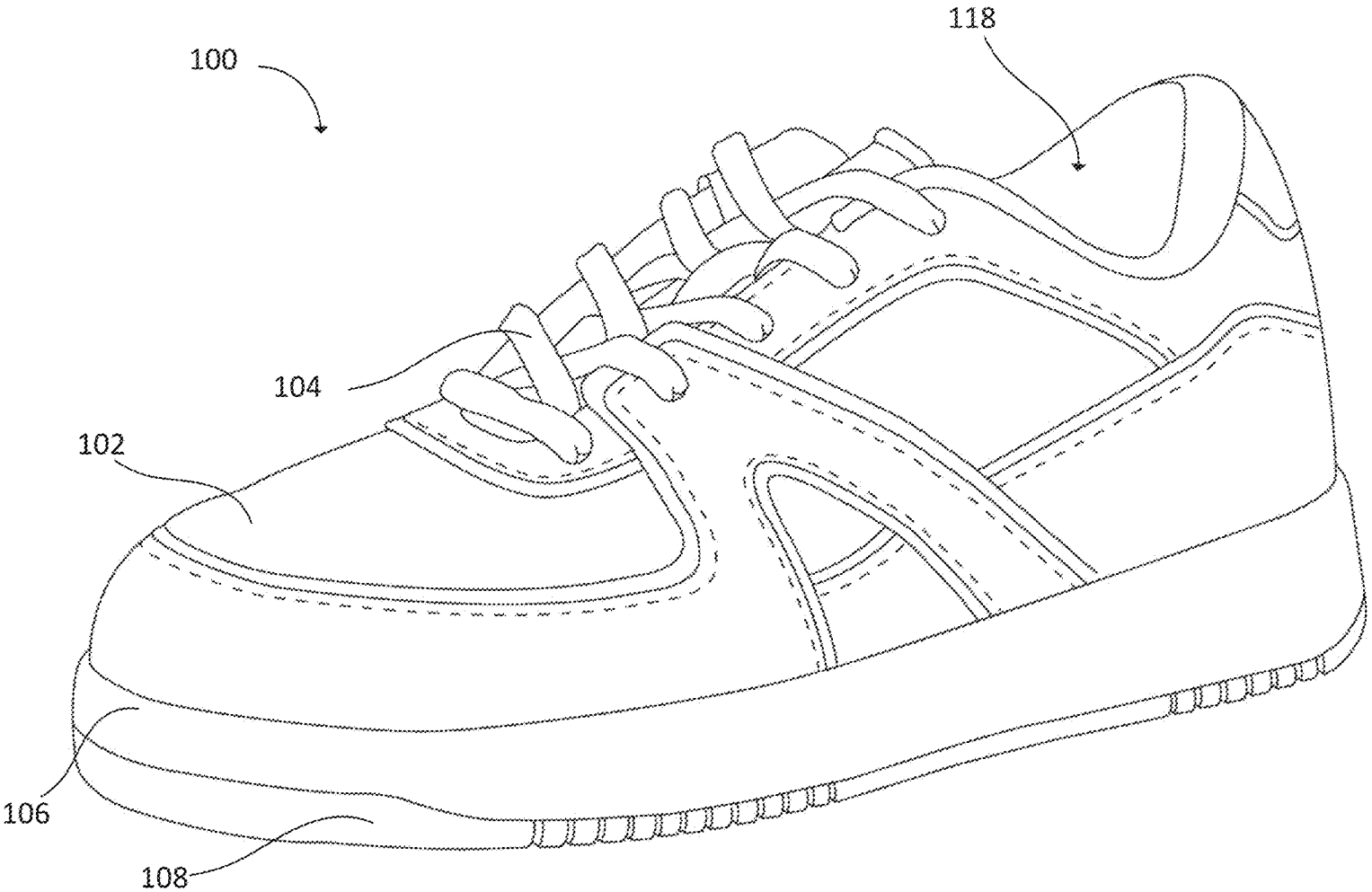
FIG. 1 depicts perspective view of a footwear, in accordance with some arrangements.

Reference is made to the accompanying drawings throughout the following detailed description. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

DETAILED DESCRIPTION

The figures and the description thereof illustrate certain example arrangements in detail, and it should be understood that the present disclosure is not limited to the details of methodology set forth in the description or illustrated in the figures. It should also be understood that the terminology used herein is for the purpose of description only and should not be regarded as limiting.

Figure 2:
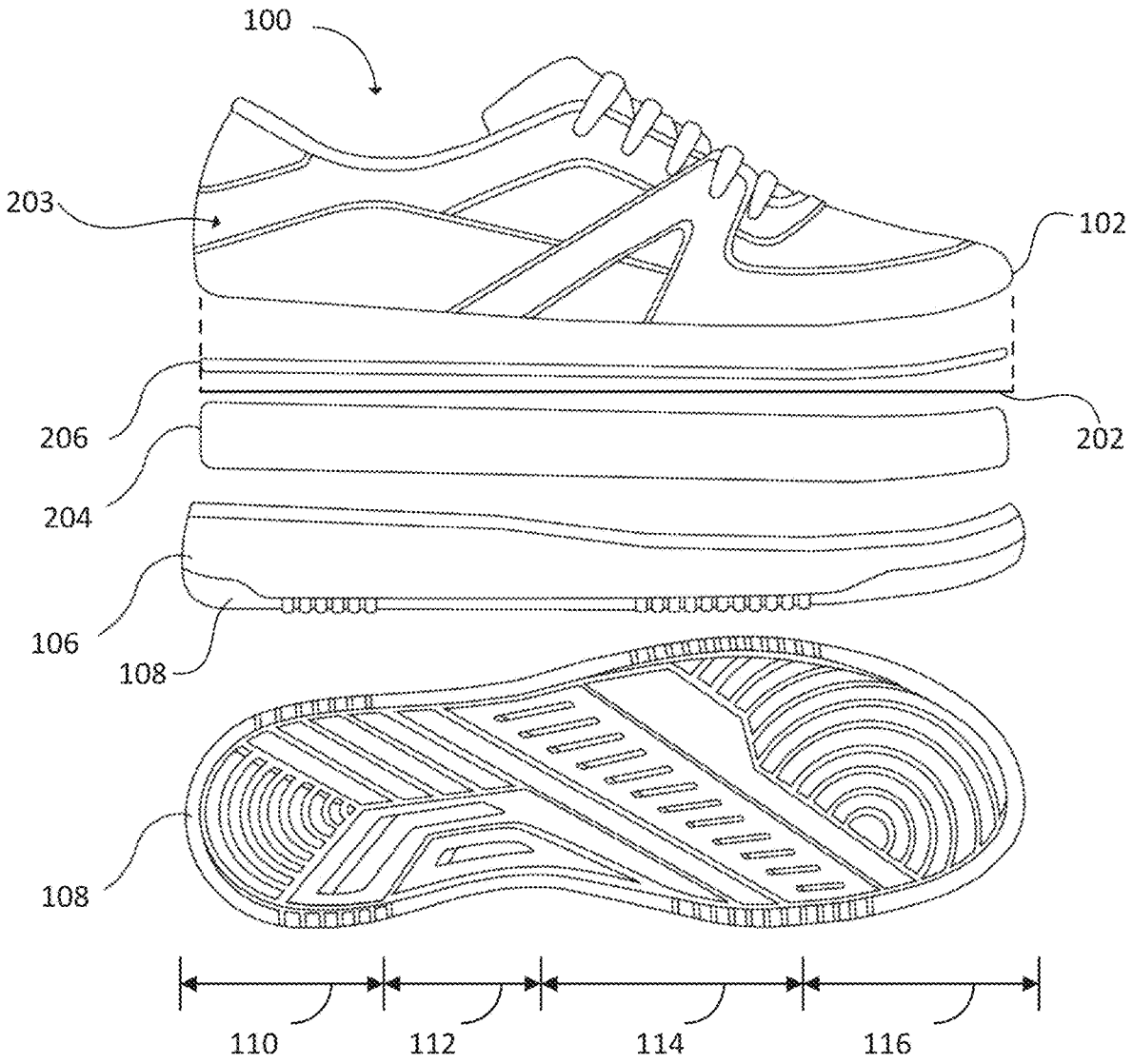
FIG. 2 depicts an exploded view of the footwear, in accordance with some arrangements.

FIG. 1 shows a footwear 100 in accordance with an arrangement. FIG. 2 shows an exploded view of the footwear 100 in accordance with an arrangement. The footwear 100 can include at least one of an upper 102, a fastening member 104, a cupsole 106, an outsole 108, a midsole 204, and a sockliner 206. The footwear 100 has various portions, including a forefoot portion 110, a ball portion 112, an arch portion 114, and a heel portion 116. The upper 102 can include an opening 118 for a foot and a fastener for coupling and tightening the footwear 100 around the foot, such as the fastening member 104, which may include, for example, laces, a zipper, and so on. The cupsole 106 can be arranged below the upper 102 and provide additional support to the foot. The outsole 108 can be designed to contact a surface (e.g., the ground, a flat hard surface such as the floor, and so on) during the normal usage of the footwear 100 by a wearer.

The forefoot portion 110 of the footwear 100 is located at the front of the footwear 100, and the forefoot portion 110 may support the toes of a foot of a wearer when the foot of the wearer is inserted into the footwear 100. The ball portion 112 is located adjacent to the forefoot portion 110, and the ball portion 112 may support the ball of a foot of a wearer when the foot of the wearer wears the footwear 100. The arch portion 114 is located adjacent to the ball portion 112, and may provide support to an arch of a foot of a wearer when the foot of the wearer is inserted into the footwear 100. The heel portion 116 is located adjacent to the arch portion 114 and at the rear of the shoe, and may provide support to a heel of a foot of a wearer when the foot of the wearer is inserted into the footwear 100.

The upper 102 can be a vamp (e.g., top part of the footwear 100. The upper 102 can be a topline. The upper 102 can receive and/or house the foot of the wearer. The upper 102 can protect the foot from external elements (e.g., rain). The upper 102 can provide structural support to the footwear 100. The upper 102 can provide ventilation to keep the foot cool and dry.

The upper 102 can include an exterior surface. The exterior surface can be at least one of an outer surface, an outer shell, and/or an exterior finish of the upper 102. The exterior surface can include a design. The design can be an arrangement shown in FIGS. 1 and 2. The exterior surface can include holes in the forefoot portion 110 to provide ventilation. The exterior surface can include ridges and/or protrusions. The exterior surface can include raised surfaces. The exterior surface can include stitching. The exterior surface can include eyelets (e.g., holes) for the fastening member 104. The exterior surface can include a material. The material can be a fabric. The material can be leather. The upper 102 can include a tongue located below the fastening member 104. The upper 102 can include the opening 118. The opening 118 can be an entrance for the foot. The opening 118 can have a circumference greater than or equal to the circumference of an ankle of the foot. At least a portion of the opening 118 can be located in the arch portion 114 and the heel portion 116. The upper 102 can include a tongue. The tongue can be located below the fastening member 104. The tongue can be at least one of a flap, a shoe throat, and/or a front cover. The tongue can expand the opening 118. The tongue can be moved. The tongue can be adjusted. The tongue can be adjusted by a user to increase or decrease a size of the opening 118 and/or loosen or tighten the fastening member 104. The tongue can have a length. The length of the tongue can be equal to and/or similar to a length of the arch portion 114. The tongue can have a generally rectangular shape. The tongue can have curved edges. The tongue can include a fabric. The tongue can include a cushioning material.

The upper 102 can include a collar located at the opening 118. The collar can be the opening 118. The collar can be a padding, a lining, and/or ankle support for the upper 102. The collar can be located around a circumference of the opening 118. The collar can be in contact with the tongue. The collar can include a fabric. The collar can include a cushioning material. The collar can have a generally elliptical shape. The fastening member 104 can tighten the footwear 100 around the foot to retain (e.g., keep) the footwear 100 on the foot. The fastening member 104 can be at least one of a fastener, a binding component, and/or a tightening mechanism. The fastening member 104 can be at least one of laces, a zipper, buttons, straps, and/or Velcro. The fastening member 104 can have a length. The length of the fastening member 104 can be equal to or less than the length of the tongue. The fastening member 104 can be located above the tongue. The fastening member 104 can be in contact with the exterior surface. The fastening member 104 can be coupled to the exterior surface. The fastening member 104 can be coupled by being adhered to, drilled into, sewed to, stuck to, and/or pinned to the exterior surface.

Figure 7:
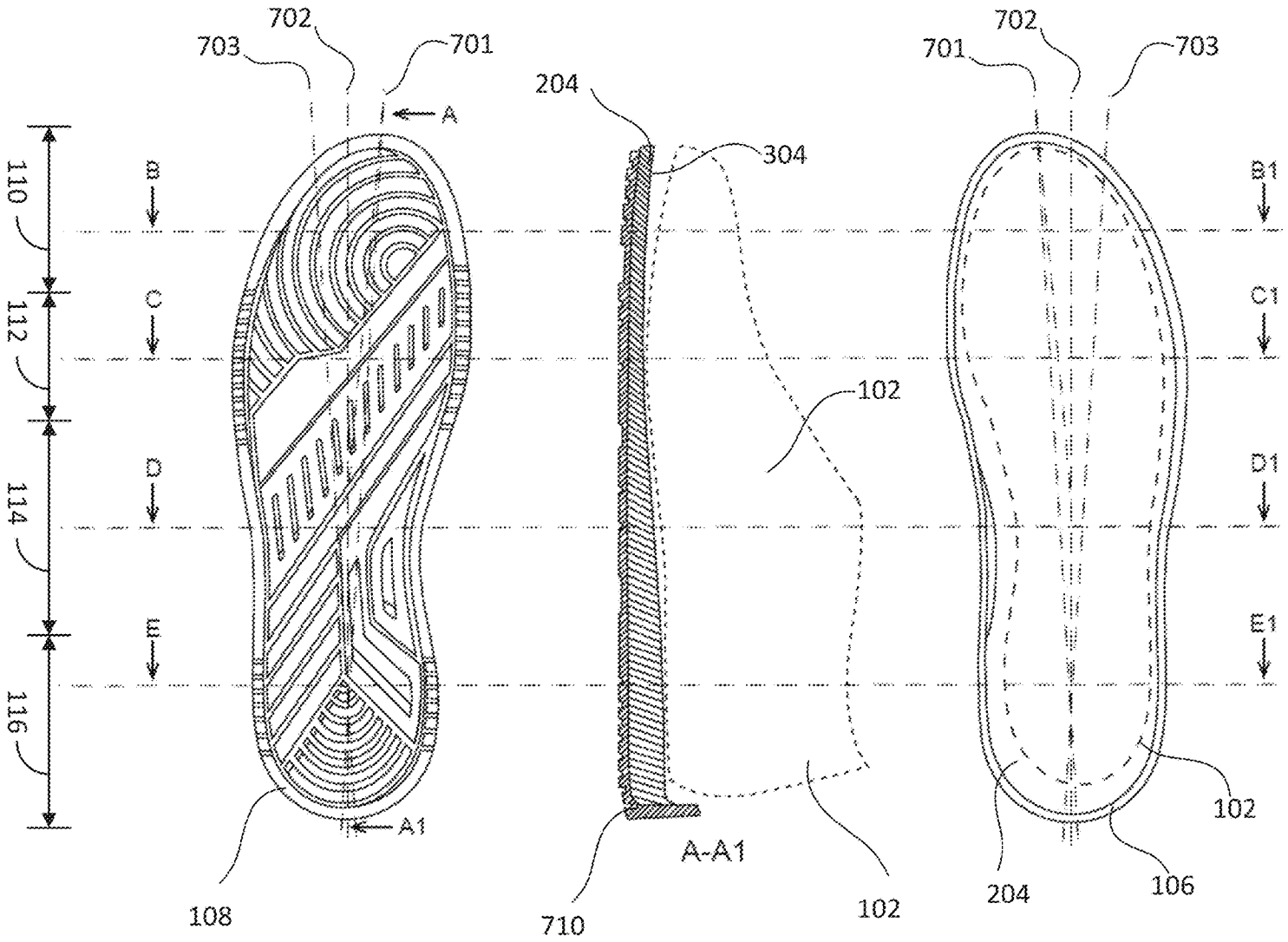
FIG. 7 depicts the bottom view, the top view, and a cross-section view of an example footwear, in accordance with some arrangements.

The upper 102 can include a bottom plate 202. The bottom plate 202 can be at least one of a base, a footbed, and/or a baseplate for the upper 102. The bottom plate 202 can be a bottom portion of the upper 102. The bottom plate 202 can span a length of the footwear 100. The bottom plate 202 can include a material. The material can be fabric. The bottom plate 202 can have a length. The length of the bottom plate 202 can be a length of the bottom plate 202 along at least one of a last center line 701, a profile center line 702, and a heel center line 703 (as shown in FIG. 7). The length of the bottom plate 202 can span from the forefoot portion 110 to the heel portion 116. The bottom plate 202 can be a surface on which the foot is on and/or rests. The upper 102 can include a wall 203. The wall 203 can include the exterior surface of the upper 102. The wall 203 can be at least one of side walls, a lateral wall, or an enclosure. The wall 203 can be composed of a material. The material can be fabric. The material can be leather. The bottom plate 202 and the wall 203 of the upper 102 can be coupled. The wall 203 can be coupled to the opening 118. The wall 203 can be coupled to the opening 118 by at least one of adhesion, being manufactured together, and/or being sewed together. The wall 203 can have a height. A maximum height of the wall 203 can be from the collar to the bottom plate 202. A minimum height of the wall 203 can be in the forefoot portion 110 of the footwear 100. The bottom plate 202 and the wall 203 of the upper 102 can be coupled by at least one of an adhesive, being sewed together, and/or being stapled together. The length and width of the bottom plate 202 can be a length and width of the upper 102. The height of the wall 203 can be a height of the upper 102. The width of the bottoms plate 202 can be different along the length of the bottom plate 202. For example, the width of the bottom plate 202 at the forefoot portion 110 can be different from the width of the bottom plate 202 at the heel portion 116. The width of the bottom plate 202 and the upper 102 can be a width of the bottom plate 202 and the upper 102 along at least one of a horizontal line, a crosswise line, a transverse line, or a lateral line. The bottom plate 202 and the wall 203 can form at least one of a cavity, receiving space, and/or receptacle for the foot. The opening 118 can be located on a top surface of the wall 203.

The upper 102 can provide stability to the foot. The upper 102 can prevent movements that could harm the foot (e.g., rolling an ankle of the foot). The upper 102 can secure the foot.

Figure 3:
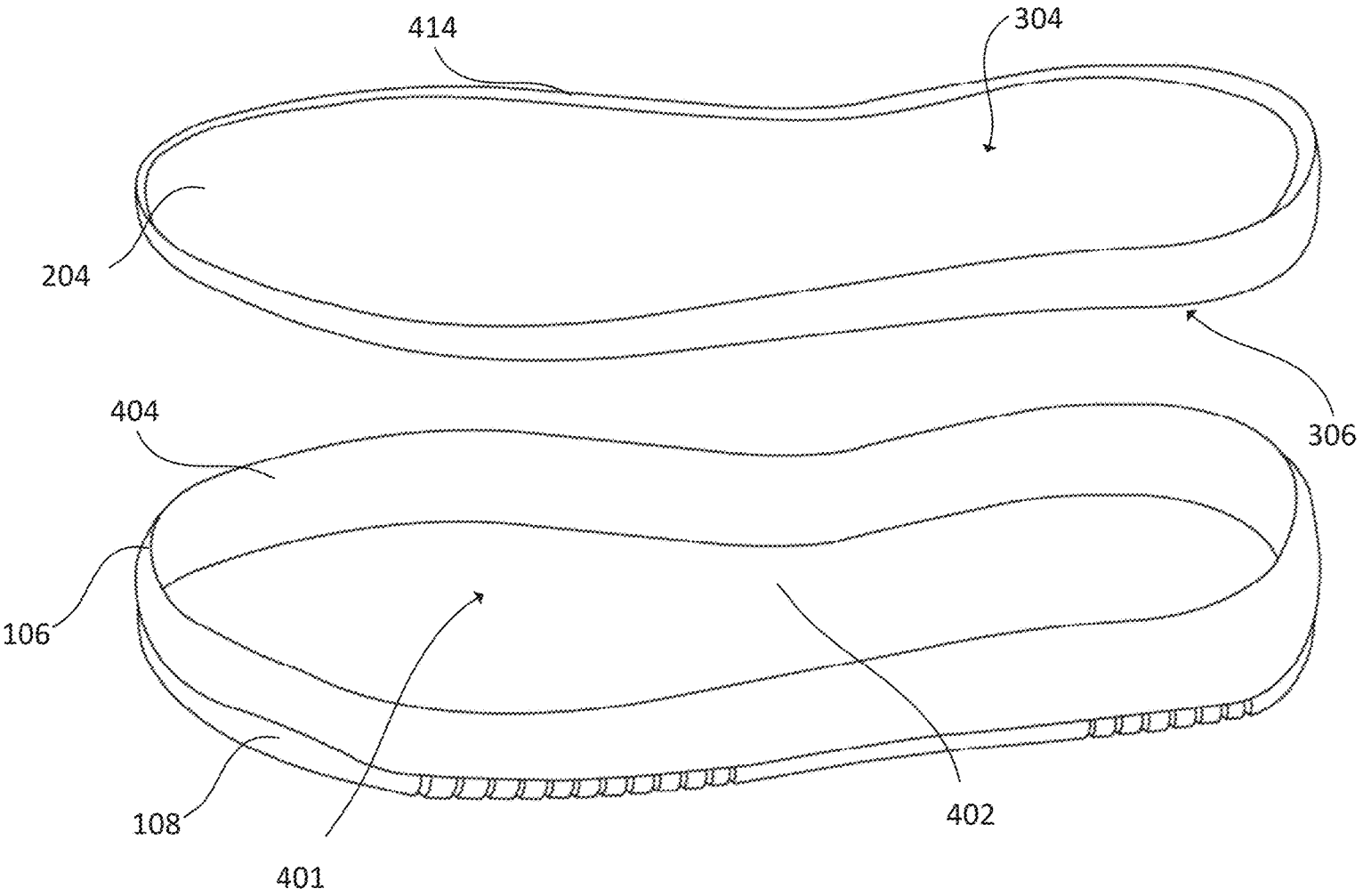
FIG. 3 depicts perspective views of a cupsole and a midsole of the footwear, in accordance with some arrangements.
Figure 4:
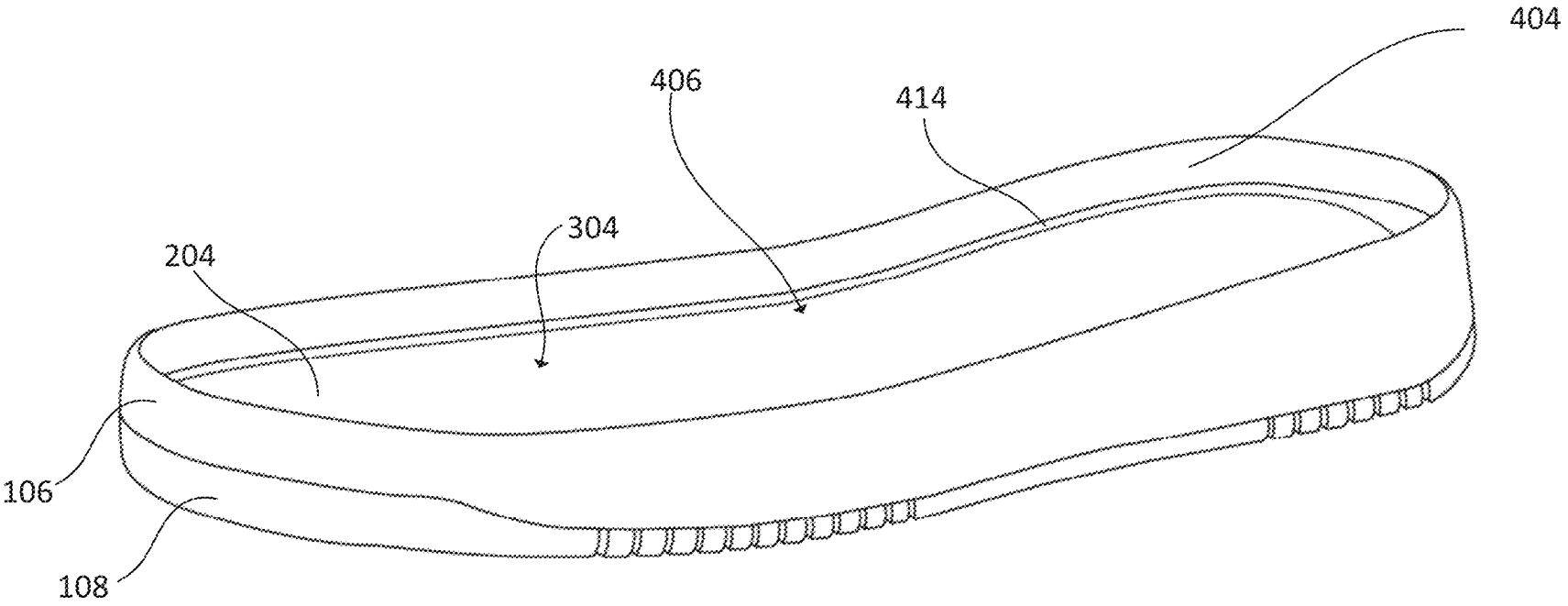
FIG. 4 depicts a perspective view of a midsole arranged within and coupled to the cupsole, in accordance with some arrangements.

FIG. 3 perspective view of the midsole 204, the cupsole 106, and a first receptacle 401, according to some arrangements. FIG. 4 depicts a perspective view of a midsole 204 arranged within and coupled to the cupsole 106, and a second receptable 406, according to some arrangements. The midsole 204 can be at least one of a cushioning layer, a midsole cushion, a shock absorber, a support layer, a comfort layer, an inner sole, and so on. The first receptacle 401 can be at least one of a chamber, compartment, holder, and/or cavity.

The midsole 204 can cushion the foot of the wearer to provide comfort and reduce energy that the wearer expends while performing athletic activities by being compressed in response to an applied force by the wearer and decompressed in response to a removal of the force. The midsole 204 as described herein can provide energy return to the wearer equally across an entire area below the foot by spanning the length and the width of the foot of the wearer to maximize comfort and energy usage. Furthermore, the midsole 204 can augment and enhance movement of the wearer by compressing further in a direction of the applied force by the wearer. For example, the midsole 204 can boost both speed and balance of the wearer by providing energy return in response to a downwards applied force. The midsole 204 can be composed of a flexible and resilient material (e.g., the second flexible material). The midsole 204 can thus apply springing force to the footwear 100 and increase both a speed and jumping height of the wearer by returning energy expended by the wearer back to the wearer. The midsole 204 can give additional bounce (e.g., springing force) to movement of the wearer (e.g., while walking) by decompressing faster than compression of the midsole 204. Aside from improving quantifiable athletic performance (e.g., jumping height) of the wearer, the midsole 204 can also alleviate pressure from various joints (e.g., knees) of the wearer to increase comfort and length a time that the wearer can participate in athletic activities by cushioning the entire area below the foot. The midsole 204 can absorb pressure and enhance performance of sudden movements (e.g., suddenly stopping and changing directions while running) by cushioning the direction of the applied force. The midsole 204 can absorb shock (e.g., sudden movements) of the wearer to reduce strain on the foot and joints of the wearer as well as mitigate injury. A risk of injury can also be reduced by the midsole 204 distributing force evenly across the midsole 204 to provide stability to the entire area below the foot. The midsole 204 can redirect force exerted on the foot away from the foot and to the midsole 204. The midsole 204 can absorb pressure and/or force generated by the wearer by compressing to a degree corresponding to an amount of force applied at a portion of the midsole 204. As a result, the midsole 204 can elevate athletic performance of the wearer and allow for wearers with health-related issues, joint pains, and/or other problems that would preclude the wearer from participating in athletic activities. The midsole 204 can align the foot within the footwear 100 to provide maximum comfort and energy efficiency to the wearer.

The midsole 204 can compress, constrict, and/or condense in response to an applied force. The midsole 204 can compress in response to a downwards force applied by the foot. The applied force can be from the foot of the wearer. The applied force can be in response to the wearer performing an activity such as downwards movements while running, walking, and/or jumping. The midsole 204 can store energy when compressed. The midsole 204 can expand (e.g., return to its original state) when the force is removed. The force can be removed by the wearer resting and/or upwards movements. The midsole 204 can compress more or less in response to an amount of force. The amount of force can vary based on movement of the wearer. For example, the amount of force exerted by the wearer when running can be greater than the amount of force exerted when walking. The midsole 204 can release energy when expanded. The midsole 204 can mold around the foot of the wearer. The midsole 204 can maintain its shape.

The midsole 204 has a first portion corresponding to the arch portion 114 and heel portion 116. The midsole 204 has a second portion corresponding to the forefoot portion 110 and the ball portion 112. The midsole 204 can have a thickness. The first portion of the midsole 204 generally has a thickness that is greater than the that of the second portion of the midsole 204. The first portion of the midsole 204 can provide comfort and energy absorption than the second portion of the 204 due to such difference in thickness, given that the heel and arch portion of the wearer's foot may benefit from more protection. The midsole 204 has a minimum thickness that corresponds to a maximum compression of the midsole 204. A maximum compression at a portion of the midsole 204 can correspond to a maximum energy absorption and/or storage at that portion of the midsole 204. The midsole 204 can have a length. The length of the midsole 204 can be a length of the midsole 204 along at least one of a last center line 701, a profile center line 702, and a heel center line 703. The length of the midsole 204 can be equal to the length of the upper 102. The length of the midsole 204 can be greater than the length of the upper 102. The length of the midsole 204 can be greater than or equal to a length of the foot of the wearer. The midsole 204 can have a width. The width of the midsole 204 can be equal to the width of the upper 102. The width of the midsole 204 can be greater than the width of the upper 102. The width of the midsole 204 can be a width of the midsole 204 along at least one of a horizontal line, a crosswise line, a transverse line, or a lateral line that is perpendicular to or transverse to the length. The midsole 204 can have a shape that generally corresponds to a shape of the bottom plate 202 of the upper 102. The midsole 204 can have a volume. The midsole 204 can have a volume in the first portion of the midsole 204 greater than the second portion of the midsole 204. The midsole 204 can include a bottom surface 306 and a top surface 304. The top surface 304 of the midsole 204 can be coupled to the bottom plate 202. The top surface 304 of the midsole 204 can be coupled to the bottom plate 202 by at least one of adhesion, welding, staples, and/or sewing. The bottom plate 202 and the wall 203 can have a width equal to the width of the midsole 204. The bottom plate 202 and the wall 203 can have a length equal to the length of the midsole 204. The midsole 204 can have an area equal to the bottom plate 202. The area of the midsole 204 can be greater than the area of the bottom plate 202.

The midsole 204 can include a second flexible material. The midsole 204 can be composed of the second flexible material. The second flexible material can be resilient. The second flexible material can be a polymer. The second flexible material can be an elastomer. The second flexible material can be a thermoplastic elastomer. The second flexible material can be a supercritical material. The supercritical material can be a foam. The supercritical material can be an elastic foam. The supercritical material can be a gas-infused elastomer. The second flexible material can be ethylene-vinyl acetate (EVA). In some arrangements, the second flexible material can be Pebax. The second flexible material can be at least one of polyurethane (PU), thermoplastic polyurethane (TPU), Phylon, gel, and/or cork. The midsole 204 can be formed by compression molding. The midsole 204 can be formed by gas-injected compression molding. The second flexible material can be infused with liquid gas. The liquid gas can vaporize in the second material. Vaporization of the gas in the second flexible material can create air pockets (e.g., bubbles) in the second material. The second flexible material can have air pockets and/or chambers. The second flexible material can include air cushioning. The second flexible material can be a foam. The second flexible material can be a polymer injected with gas that becomes a foam. The gas can be a foaming agent. The second flexible material can provide cushioning. The gas can be nitrogen. The gas can be carbon dioxide. The second flexible material can be a gas-infused elastomer. The midsole 204 can have a durometer between 40 to 60 Asker C. The durometer of the midsole 204 can be a second durometer.

In some arrangements, the midsole 204 can be at least one of tuned, adjusted, adapted, and/or configured for functions related to athletic activity (e.g., speed, balance, cushioning, shock absorption). For example, the midsole 204 can have a maximum compression to provide an enhanced cushioning effect greater than the maximum compression to enhance speed. The midsole 204 can be tuned, adjusted, adapted, and/or configured for a set of functions related to athletic activity. The midsole 204 can be tuned by choice of the material of the midsole 204. The midsole 204 can be tuned by increasing or decreasing a quantity of air pockets in the midsole 204. The midsole 204 can be tuned by changing the thickness of the midsole 204.

The midsole 204 can be a full-length midsole. The midsole 204 can span a length of the foot of the wearer. The midsole 204 can span the length of the upper 102. The midsole 204 can provide comfort and cushion to an entire area below the foot. As such, the midsole 204 can compress in response to any movement and/or action of the foot and store energy generated by the wearer. The midsole 204 can expand in response to any movement and/or action of the foot to release energy and boost performance of the wearer. The midsole 204 can enhance and/or augment any movement and/or action across the length of the upper 102. The midsole 204 can complement movement of the foot. The midsole 204 can enhance performance of any movement and/or action of the foot.

The cupsole 106 can be a base sole, a structured sole, a molded sole, and so on. The cupsole 106 can be coupled to the outsole 108. The cupsole 106 can be coupled to the outsole 108 by at least one of adhesion, being manufactured together, being molded together, and/or welding.

The cupsole 106 can include the first receptacle 401. The cupsole 106 can provide support to the midsole 204. The cupsole 106 can provide structural stability to the midsole 204. The midsole 204 can be located in, disposed, and/or arranged in the first receptacle 401. The cupsole 106 can flex corresponding to compression of the midsole 204. The cupsole 106 can provide the footwear 100 with durability. The cupsole 106 can provide the footwear 100 with support. The cupsole 106 can provide impact protection (e.g., from the foot impacting a surface).

The cupsole 106 can be flexible and resilient. In some arrangements, the cupsole 106 can flex (e.g., bend, deform). The cupsole 106 can flex to a degree. The cupsole 106 can flex in response to an applied force. The cupsole 106 can flex in response to an applied force by the foot of the user. The foot of the user can apply a force to the cupsole 106 when performing activities (e.g., walking, running, and/or jumping). The cupsole 106 can regain its original shape when the force is removed. The cupsole 106 can maintain the original shape of the cupsole 106 when there is no applied force. The cupsole 106 can deform and/or mold to a flexing of the foot of the user. The force can be removed by the user performing a movement opposite to a movement that applied the force (e.g., raising foot).

Since the cupsole 106 can house and/or arrange the midsole 204 within the first receptacle 401, the cupsole 106 can amplify both energy return and storage of the midsole 204 to improve an overall athletic performance of the wearer. The cupsole 106 and the midsole 204, both composed of flexible and resilient materials, coupled together can optimize energy usage and movement of the wearer by compressing and decompressing in response to movements of the wearer. The first receptacle 401 of the cupsole 106 can allow the midsole 204 to freely compress and decompress to provide maximum comfort and energy efficiency to the wearer. The first receptacle 401 can expand and allow the midsole 204 to compress further and expand the area of the midsole 204, allowing for increased comfort and energy return to the wearer. The midsole 204 is not only disposed in portions of the cupsole 106, but spans the length and the width of the first receptacle 401 which spans the length and the width of the cupsole 106 to cushion the entire area below the foot. This can allow for both cupsole 106 and the midsole 204 to furnish enhanced comfort and athletic performance to the wearer. Furthermore, the cupsole 106 and the midsole 204 coupled together enhances performance, delivers comfort, and reduces risk of injury for the wearer by cushioning the entire length of the foot of the wearer. The cupsole 106 can support and provide stability to the midsole 204 so the midsole 204 can store and return energy to the wearer.

The cupsole 106 can have a first portion corresponding to the arch portion 114 and heel portion 116. The cupsole 106 can have a second portion corresponding to the forefoot portion 110 and the ball portion 112. The cupsole 106 can flex in a way that the first portion and the second portion of the cupsole 106 can touch (e.g., come into contact with). The first portion of the cupsole 106 can have a thickness greater than the second portion of the cupsole 106. There can be a difference in thickness between the first portion and the second portion of the cupsole 106. The thickness difference can be 8 mm. The thickness difference can herein be referred to as a heel to toc drop. The cupsole 106 can have a length. The length of the cupsole 106 can be a length of the cupsole 106 along at least one of a last center line 701, a profile center line 702, and a heel center line 703. The cupsole 106 can have a width. The length of the cupsole 106 can be greater than the length of the midsole 204. The width of the cupsole 106 can be greater than the width of the midsole 204. The width of the cupsole 106 can be a width of the cupsole 106 along at least one of a horizontal line, a crosswise line, a transverse line, or a lateral line. The length of the cupsole 106 can be greater than the length of the upper 102. The width of the cupsole 106 can be greater than the width of the upper 102. In some arrangements, a portion of the second portion of the cupsole 106 can be curved. The first portion of the midsole 204 can correspond to a back of the cupsole 106. The second portion of the midsole 204 can correspond to a front of the cupsole 106.

The cupsole 106 can include a first flexible material. The cupsole 106 can be composed of a first flexible material. The first flexible material can be different from the second flexible material of the midsole 204. The first flexible material can be different from the second flexible material. The first flexible material can be resilient. The first flexible material can be an elastomer. The first flexible material can be rubber. The first flexible material can be at least one of EVA, PU, a thermoplastic rubber (TPR), Phylon, cork, gum rubber, natural rubber, synthetic rubber, butyl rubber, and/or leather. The cupsole 106 can be formed by injection molding. The first flexible material can have a first durometer between 50 to 70 Shore A. The first durometer of the first flexible material can be different than the second durometer of the second flexible material. The first durometer of the first flexible material can be higher than the second durometer of the second flexible material. In some examples, ratio of the first durometer to the second durometer is within the range of 0.8-1.75. The selection of the first and second durometers as well as the ratios thereof can improve the energy dissipation and improve performance of the footwear 100 as discussed herein.

The cupsole 106 can include an inner surface 402 and a lateral wall 404. The inner surface 402 can be a base, an interior layer, and/or a panel of the cupsole 106. The lateral wall 404 can be at least one of a barrier, a boundary, and/or a retaining wall. The inner surface 402 and the lateral wall 404 can form the first receptacle 401. The inner surface 402 can be formed and/or molded with the lateral wall 404. The inner surface 402 can be coupled to the lateral wall 404. The inner surface 402 can be coupled to the lateral wall 404 by at least one of an adhesive, sewing, staples, pins, and/or welding. The inner surface 402 can have a shape that generally corresponds to the midsole 204. The inner surface 402 can have a length and a width equal to the midsole 204. The lateral wall 404 can be located on a circumference of the inner surface 402. The lateral wall 404 can have a height. The lateral wall 404 can have an equal (e.g., consistent) height around the circumference of the inner surface 402. The inner surface 402 can have a first portion corresponding to the arch portion 114 and heel portion 116. The inner surface 402 can have a second portion corresponding to the forefoot portion 110 and the ball portion 112. A thickness of the first portion of the inner surface 402 can be greater than a thickness of the second portion of the inner surface 402. A portion of the lateral wall 404 can extend beyond the top surface 304 of the midsole 204 when the midsole is arranged within the first receptacle 401. The portion of the lateral wall 404 that extends beyond the top surface 304 of the midsole 204 can have a first thickness in the first portion. The portion of the lateral wall 404 that extends beyond the top surface 304 of the midsole 204 can have a second thickness in the second portion. The first thickness can be greater than the second thickness. The portion of the lateral wall 404 that extends beyond the top surface 304 of the midsole 204 can form a second receptacle 406. The second receptacle 406 can be formed when the midsole 204 is arranged within the first receptacle 401. The second receptacle 406 can be formed by the top surface 304 of the midsole 204 and the lateral wall 404. There can be a distance between the top surface 304 of the midsole 204 and a top surface of the lateral wall 404. The distance in the first portion of the cupsole 106 between the top surface 304 of the midsole 204 and a top surface of the lateral wall 404 can be less than the distance in the second portion. The portion of the lateral wall 404 that extends beyond the top surface 304 of the midsole 204 can have a first thickness in the first portion and a second thickness at the second portion. The first thickness can be less than the second thickness. The midsole 204 can have a thickness of about 80% of the height of the lateral wall 404 in the first portion. The midsole 204 can have a thickness of about 50% of the height of the lateral wall 404 in the second portion.

The first receptacle 401 can be formed by the inner surface 402 and the lateral wall 404. The first receptacle 401 can have an area that extends across (e.g., from) the first portion of the cupsole 106 to the second portion of the cupsole 106. The first receptacle 401 can be formed by a hollowing (e.g., carving out) of the cupsole 106. An area of the first receptacle 401 can be equal to the area of the midsole 204. A length of the first receptacle 401 can be equal to the length of the midsole 204. The midsole 204 can extend to an entire length of the first receptacle 401. A width of the first receptacle 401 can be equal to the width of the midsole 204. The first receptacle 401 can have a depth. The depth of the first receptacle 401 can correspond to (e.g., be equal to) the height of the lateral wall 404. The first receptacle 401 can have a shape that generally corresponds to the midsole 204.

The midsole 204 can be coupled to the cupsole 106. The midsole 204 can be coupled to the cupsole 106 by adhesion. The midsole 204 can be coupled to the cupsole 106 by an adhesive. In some arrangements, the midsole 204 can be coupled to the cupsole 106 by at least one of sewing, stapling, pinning, and/or welding. The midsole 204 can be coupled to the inner surface 402 of the cupsole 106. The midsole 204 can be coupled to the inner surface 402 and the lateral wall 404 of the cupsole 106. The midsole 204 can be arranged, disposed, and/or located in the first receptacle 401.

The upper 102 can be coupled to the top surface 304 of the midsole 204. The bottom plate 202 can be coupled to the top surface 304 of the midsole 204. The upper 102 can be coupled to the top surface 304 of the midsole 204 by an adhesive. In some arrangements, the upper 102 can be coupled to the top surface 304 of the midsole 204 by at least one of sewing, stapling, pinning, and/or welding. The upper 102 can be arranged (e.g., located, disposed) in the second receptacle 406. The bottom plate 202 can be arranged within in the second receptacle 406. A portion of the upper 102 can be covered (e.g., concealed) by the lateral wall 404 forming the second receptacle 406.

In some arrangements, the lateral wall 404 of the cupsole 106 can flex (e.g., deform). The cupsole 106 can flex in lateral directions. The cupsole 106 can flex in lateral directions perpendicular to at least one of the top surface 304 of the midsole 204, the bottom surface 306 of the midsole 204, the inner surface 402 of the cupsole 106, or the bottom plate 202 upon compression of the midsole 204 by a force. The lateral wall 404 can flex in response to an applied force. The lateral wall 404 can flex in response to an applied force by the foot of the user. The lateral wall 404 can flex in response to compression of the midsole 204. The lateral wall 404 can flex to an extent of the compression of the midsole 204. The lateral wall 404 can have a maximum degree of flexing corresponding to a maximum compression of the midsole 204. Flexing of the lateral wall 404 can extend the area of the first receptacle 401. A maximum area of the first receptacle 401 can correspond to the maximum compression of the midsole 204. Compression of the midsole 204 can expand the area of the first receptacle 401. The foot of the user can apply a force to the lateral wall 404 when performing activities. The lateral wall 404 can return to its original shape when the force is removed. The lateral wall 404 can maintain its shape in the absence of force. A top portion of the lateral wall 404 can flex to increase the area of the first receptacle 401. A middle portion of the lateral wall 404 can flex and cause the lateral wall 404 to concave to increase the area of the first receptacle 401. Furthermore, the lateral wall 404 of the first receptacle 401 can flex and expand the area in which the midsole 204 can compress to, increasing the energy storage and the energy return of the midsole 204 to further enhance athletic performance and comfort of the wearer.

The lateral wall 404 can be flexible. The lateral wall 404 can be durable. The lateral wall 404 can be resistant to deformation. The lateral wall 404 can retain its dimensions and shape.

In some arrangements, the midsole 204 can be coupled to the inner surface 402 of the cupsole 106. The midsole 204 can be coupled to the inner surface 402 of the cupsole 106 by an adhesive. The bottom surface 306 of the midsole 204 can be coupled to the inner surface 402 of the cupsole 106. The midsole 204 being coupled to the inner surface 402 of the cupsole 106 can provide for increased compression compared to the midsole 204 being coupled to the lateral wall 404 and the inner surface 402 of the cupsole 106. The lateral wall 404 can flex (e.g., deform, expand). The first receptacle 401 can increase in area when the lateral wall 404 flexes. An increase in the area of the midsole 204 can correspond to the increase in area of the first receptacle 401. The midsole 204 can have a greater maximum compression when the midsole 204 is coupled to the inner surface 402 of the cupsole 106 than when the midsole 204 is coupled to both the inner surface 402 and the lateral wall 404 of the cupsole 106. The midsole 204 can have a greater energy absorption and energy storage when the midsole 204 is coupled to the inner surface 402 of the cupsole 106 than when the midsole 204 is coupled to both the inner surface 402 and the lateral wall 404 of the cupsole 106. The midsole 204 can redirect pressure laterally across the midsole 204. The lateral redirection of pressure can cause the lateral wall 404 of the cupsole 106 to flex. The lateral redirection can be perpendicular to at least one of the top surface 304 of the midsole 204, the bottom surface 306 of the midsole 204, the inner surface 402 of the cupsole 106, or the bottom plate 202 upon compression of the midsole 204 by a force. The midsole 204 can enhance movement of the user and provide comfort to the user. The midsole 204 can reduce discomfort and adverse pressure on the user.

In some arrangements, the midsole 204 can be coupled to the inner surface 402 and the lateral wall 404 of the cupsole 106. The midsole 204 can be coupled to the inner surface 402 and the lateral wall 404 of the cupsole 106 by an adhesive. The midsole 204 being coupled to both the inner surface 402 and the lateral wall 404 of the cupsole 106 can allow for the cupsole 106 to provide additional support and stability to the midsole 204.

The footwear 100 can include the outsole 108. The outsole 108 can include at least one of a sole, a bottom sole, a tread, an outer sole, and so on. The outsole 108 can include a bottom (e.g., base) of the footwear 100. The outsole 108 can be coupled to the cupsole 106 via at least one of adhesion, sewing, stapling, and so on. In some examples, the outsole 108 and the cupsole 106 can be provided together (e.g., molded together) as a unitary construction.

The outsole 108 can increase (e.g., provide) friction between the footwear 100 and a surface (e.g., a hard court surface) on which the footwear 100 is placed. The outsole 108 can provide traction to enhance movement and athletic performance of the wearer. The outsole 108 can include a material such as elastomer, rubber, and so on. In some examples, the material of the outsole 108 can include at least one of EVA, PU, TPU, carbon rubber, natural rubber, gum rubber, synthetic rubber, and so on.

The tread, if any, on the outsole 108 has a pattern, which is designed specifically for the outsole 108 and the footwear 100. The tread can include at least one of texture, marks, grooves, and so on. The tread can provide the outsole 108 with traction and grip. The tread can provide traction and grip on hard court surfaces. The outsole 108 can have length equal to the length of the cupsole 106, (e.g., along one or more of the last center line 701, profile center line 702, and heel center line 703). The outsole 108 can have a width equal to the cupsole 106. As shown, the outsole 108 can have a thickness. The thickness of the outsole 108 can be less than the thickness of the cupsole 106 (e.g., the height of the wall of the cupsole 106). A portion of the outsole 108 at the forefoot portion 110 can be curved. In some arrangements, a movement of the outsole 108 can correspond to movement of the cupsole 106, given that the outsole 108 is filed to the cupsole 106. For example, the outsole 108 can flex to a same degree as the cupsole 106.

The footwear 100 can include a sockliner 206. The sockliner 206 can provide additional comfort and shock absorption to the user. The sockliner 206 can be removable. The sockliner 206 can be replaced. The sockliner 206 can include a material. The sockliner 206 can include at least one of foam, fabric, and/or a polymer. The sockliner 206 can have an area equal to or less than an area of the bottom plate 202. The sockliner 206 can be disposed and/or located in the opening 118. The sockliner 206 can be located above (e.g., on) the bottom plate 202. An area of the sockliner 206 can be equal to the area of the midsole 204. The area of the sockliner 206 can be equal to the bottom plate 202 The sockliner 206 can be in contact with the foot of the wearer.

Figure 5:
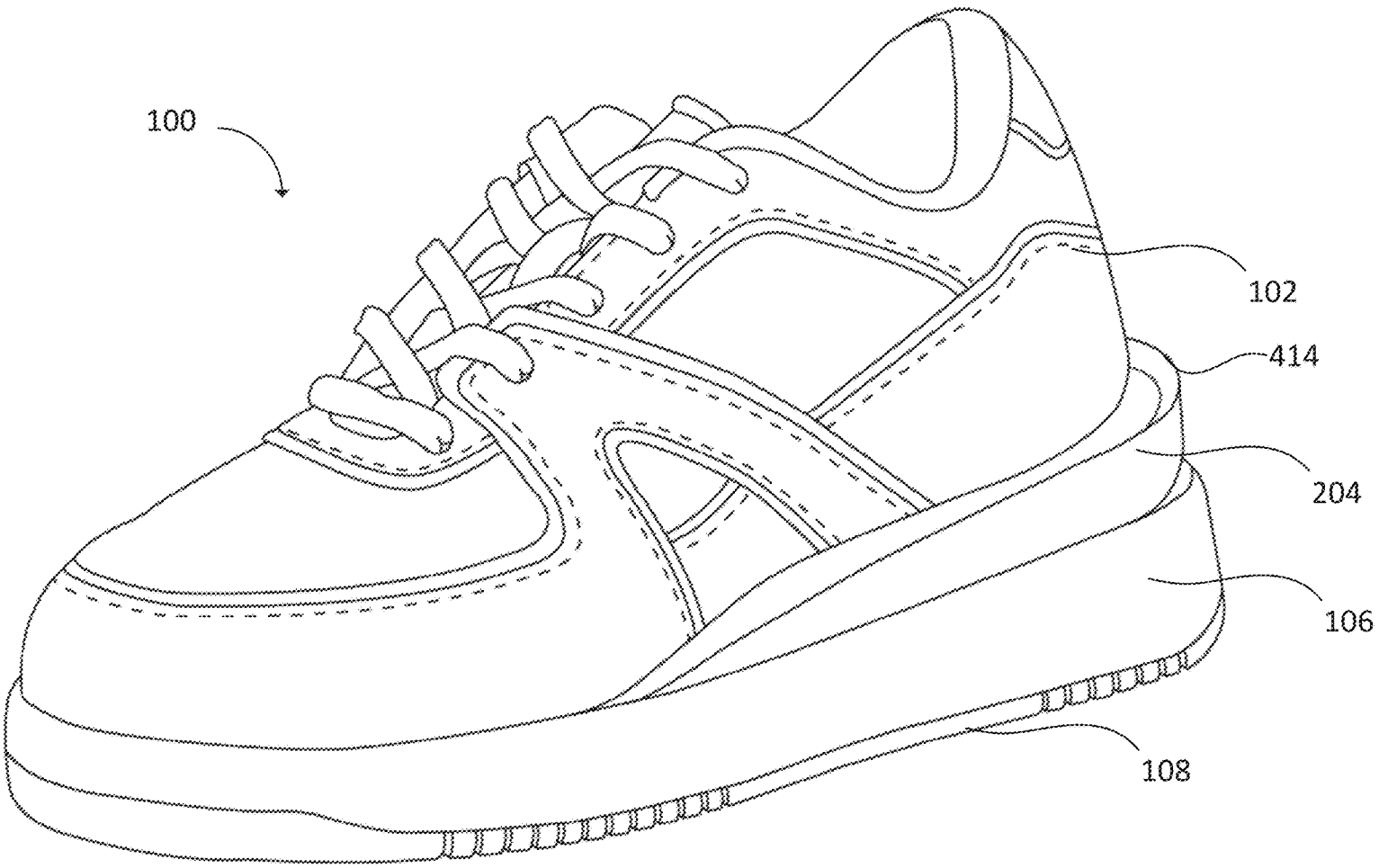
FIG. 5 depicts a semi-exploded view of the cupsole, midsole, and upper of the footwear, in accordance with some arrangements.
Figure 6:
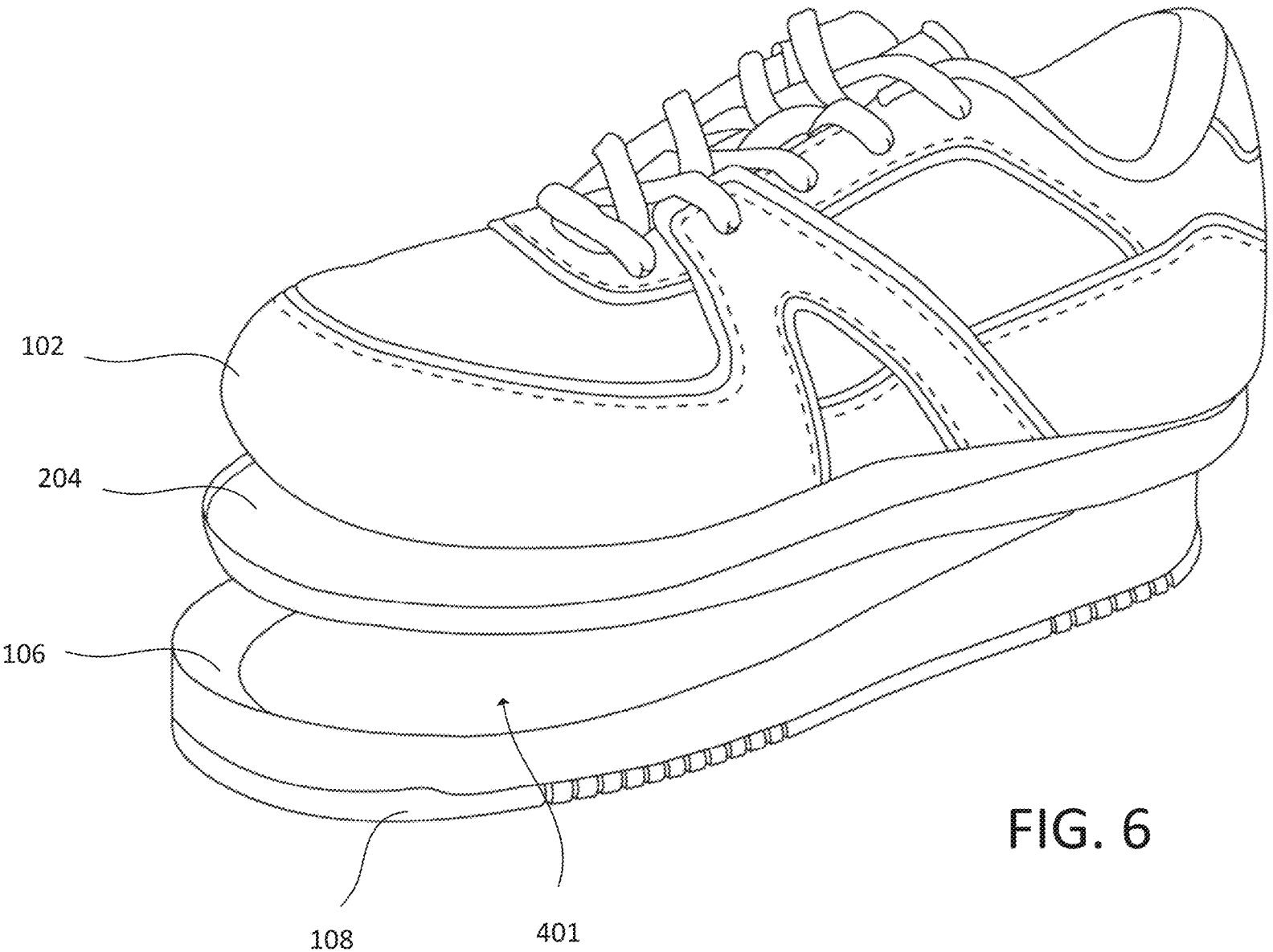
FIG. 6 depicts a semi-exploded view of the cupsole, midsole, and upper of the footwear, in accordance with some arrangements.

FIGS. 5 and 6 are exploded views of the footwear 100. The midsole 204 can be located within the cupsole 106. The upper 102 can be located on top of the midsole 204. The midsole 204 can be coupled to the cupsole 106 and the upper 102. The midsole 204 can be located within the first receptacle 401 of the cupsole 106. The midsole 204 can span the length of the first receptacle 401. The length of the first receptacle 401 can be equal to the length of the midsole 204 and the length of the upper 102.

Figure 8:
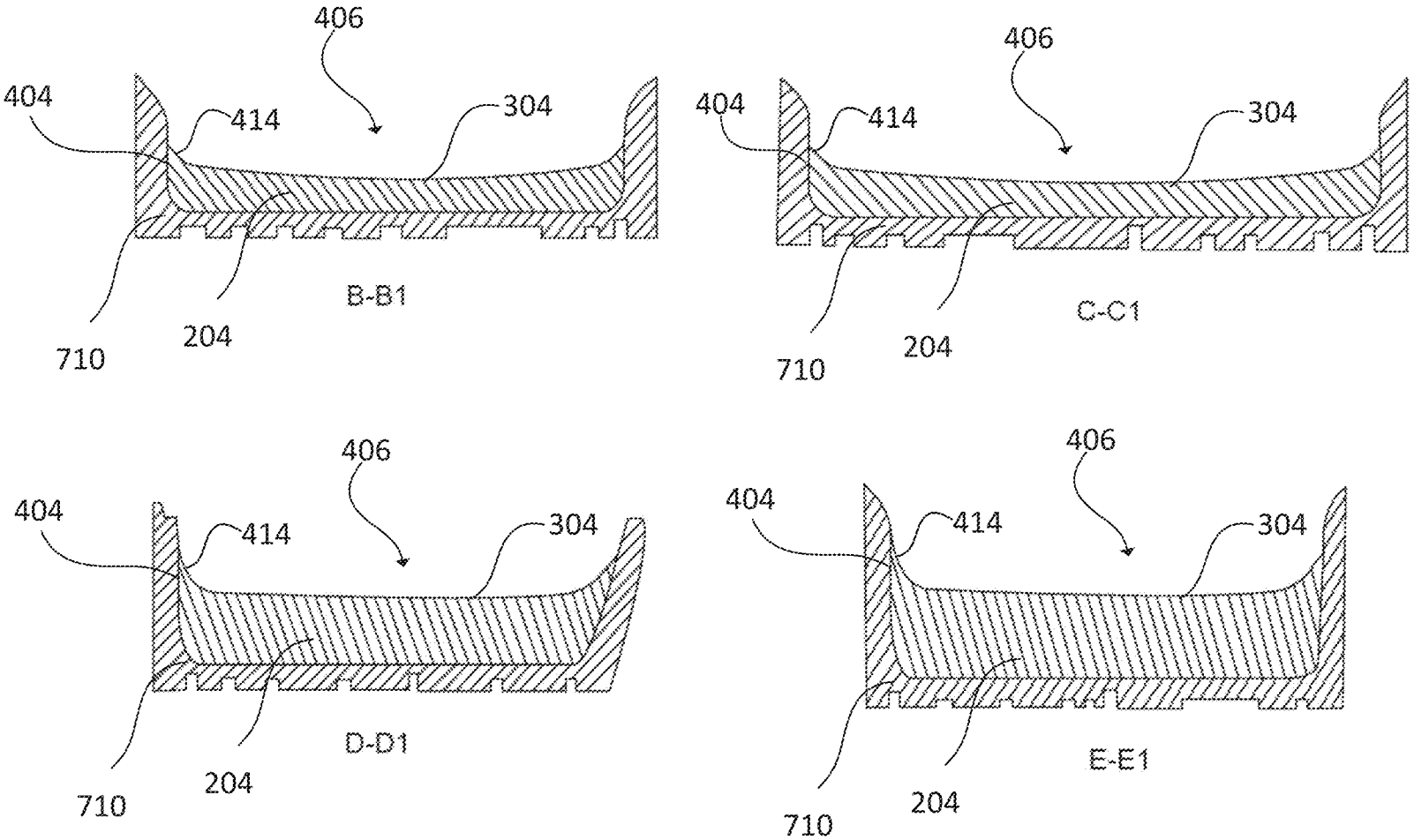
FIG. 8 depicts cross-sectional views of the example footwear shown in FIG. 7, in accordance with some arrangements.

FIG. 7 depicts the bottom view, the top view, and a cross-section view of an example arrangement of the footwear 100, in accordance with some arrangements. FIG. 8 depicts cross-sectional views of the example arrangement of the footwear 100 shown in FIG. 7, in accordance with some arrangements. The combination of the outsole 108 and the cupsole 106 are shown in FIGS. 7 and 8 as a single construction 710 (e.g., using a same shading pattern) for the sake of brevity. FIG. 7 illustrates, from left to right, the bottom view of the footwear 100 (e.g., the outsole 108), a cross-section view of the footwear 100 along A-A1 (e.g., a last center line 701), and a top view of the footwear 100. A length of the footwear 100 (and any component thereof, such as the upper 102, the cupsole 106, the midsole 204, the outsole 108, etc.) can be defined according to a last center line 701, a profile center line 702, and a heel center line 703. A width of the footwear 100 can be defined according to a line perpendicular to or transverse to the length of the footwear 100. A bottom portion of the upper 102 that includes the bottom plate 202 of the upper 102 as well as the sockliner 206 are arranged within the second receptacle 406 when the bottom portion of the upper 102 is coupled to one or more of the midsole 204 (at the top surface and/or the lateral wall 414) or the cupsole 106 (at the lateral wall 404), or arranged within the second receptacle 406.

In some arrangements, the cupsole 106 and the outsole 108 can be coupled and formed together as the construction 710. In some arrangements, the cupsole 106 (e.g., the construction 710) can include a lateral wall that forms a receptacle for receiving the midsole 204 to be arranged therein. The cross-sectional view of A-A1 illustrates that the thickness of the midsole 204 various across a length of the midsole 204. For example, a thickness of the midsole 204 in portions 114 or 116 is greater than a thickness of the midsole 204 in portion 110 or 112. FIG. 7 also depicts at least one arrangement of the tread of the outsole 108. The dashed lines in FIG. 7 represent the upper 102. In some arrangements, an area of the bottom plate 202 of the upper 102 can be less than or within an area of the top surface 304 of the midsole 204. FIG. 7 further depicts four lateral (e.g., horizontal) cross-sectional lines B-B1, C-C1, D-D1, E-E1 along the length A-A1 (e.g., a last center line 701, a profile center line 702, or a heel center line 703) of the footwear 100.

A bottom portion of the upper 102 that includes the bottom plate 202 of the upper 102 as well as the sockliner 206 are arranged within the second receptacle 406 when the bottom portion of the upper 102 is coupled to one or more of the midsole 204 (at the top surface and/or the lateral wall 414) or the cupsole 106 (at the lateral wall 404), or arranged within the second receptacle 406.

In some examples, the cross-section view B-B1 can correspond to the forefoot portion 110, the cross-section view C-C1 can correspond to the ball portion 112, the cross-section view D-D1 can correspond to the arch portion 114, and the cross-section view E-E1 can correspond to the heel portion 116. FIG. 8 depicts a variable thickness of the midsole 204 along the length of the footwear 100. As shown, the midsole 204 can decrease in thickness from the heel portion 116 to the forefoot portion 110. That is, the thickness of the midsole 204 at the cross-section view E-E1 is the greater than the thickness of the midsole 204 at the cross-section view D-D1, which is the greater than thickness of the midsole 204 at the cross-section view C-C1, which is the greater than the thickness of the midsole 204 at the cross-section view B-B1. As shown in the cross-section views in FIG. 8, and also FIGS. 4-6, the midsole 204 includes a lateral wall 414 extending around a peripheral of the midsole 204. The lateral wall 414 of the midsole 204 has an external surface configured to be coupled or to contact an inner surface of the lateral wall 404 of the cupsole 106. The lateral wall 414 of the midsole 204 has a height relative to a reference plane (e.g., the bottom surface 306 of the midsole 204) that is less than the height of lateral wall 404 the cupsole 106 (the construction 710) relative to the reference plane when the cupsole 106 is arranged within the first receptacle 401 and coupled to the cupsole 106.

Figure 9:
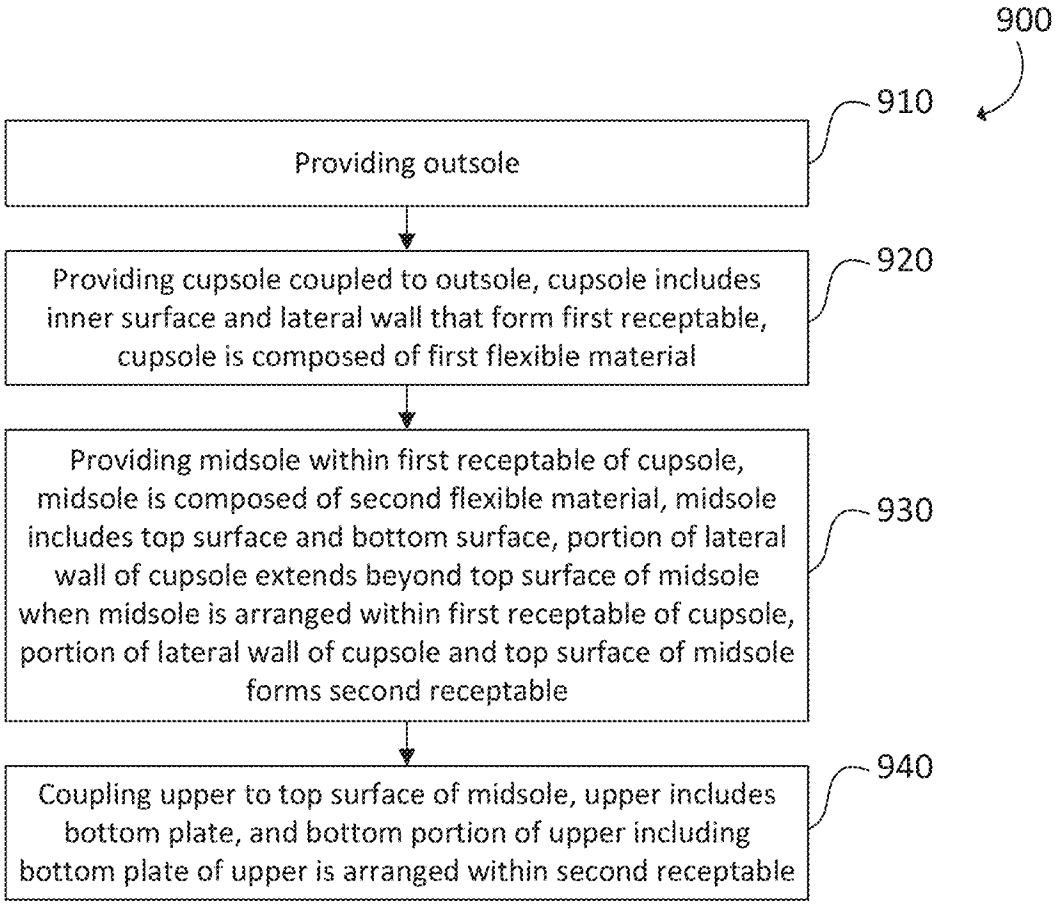
FIG. 9 is a method flowchart diagram illustrating an example method for providing the footwear, according to various arrangements.

FIG. 9 is a method flowchart diagram illustrating an example method 900 for providing the footwear 100, according to various arrangements. At 910, the outsole 108 is provided. For example, the outsole 108 can be manufactured, molded, formed, shaped, assembled, or otherwise made according to the characteristics thereof as described herein. At 920, the cupsole 106 is provided to couple the outsole 108. For example, the cupsole 106 can be manufactured, molded, formed, shaped, assembled, or otherwise made according to the characteristics thereof as described herein and coupled to the outsole 108 in the manner described herein. The cupsole 106 includes an inner surface 402 and a lateral wall 404 that form a first receptacle 401. The cupsole 106 is composed of a first flexible material.

At 930, a midsole 204 is provided within the first receptacle 401 of the cupsole 106. For example, the midsole 204 can be manufactured, molded, formed, shaped, assembled, or otherwise made according to the characteristics thereof as described herein and coupled to or arranged within the first receptacle 401 of the cupsole 106 in the manner described herein. The midsole 204 is composed of a second flexible material. The midsole 204 includes a top surface 304 and a bottom surface 306. A portion of the lateral wall 404 of the cupsole 106 extends beyond the top surface 304 of the midsole 204 when the midsole 204 is arranged within the first receptacle 401 of the cupsole 106 and coupled to the cupsole 106. The portion of the lateral wall 404 of the cupsole 106 and the top surface 304 of the midsole 204 form or define a second receptacle 406 when the midsole 204 is arranged within the first receptacle 401 of the cupsole 106 and coupled to the cupsole 106. In some examples, the portion of the lateral wall 404 of the cupsole 106, a portion of the lateral wall 414 of the midsole 204, and the top surface 304 of the midsole 204 form or define the second receptacle 406 when the midsole 204 is arranged within the first receptacle 401 of the cupsole 106 and coupled to the cupsole 106.

At 940, the upper 102 is coupled to the top surface 304 of the midsole 204. The upper 102 includes a bottom plate 202. A bottom portion of the upper 102 that includes the bottom plate 202 of the upper is arranged within the second receptacle 406.

In some examples, the outsole 108 is molded via injection molding. In some examples, the cupsole 106 is molded via injection molding. In some examples, the first flexible material comprises an elastomer. In some examples, the midsole 204 is molded via gas-injected compression molding. In some examples, the second flexible material comprises a gas-infused elastomer. In some examples, the upper 102 is assembled via patterning, cutting, stitching, and adhesion. In some examples, the outsole 108, the cupsole 106, the midsole 204, and the upper 102 are coupled to one another via adhesion.

No claim element herein is to be construed under the provisions of 35 U.S.C. § 112 (f), unless the element is expressly recited using the phrase "means for."

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic. For example, circuit A communicably "coupled" to circuit B may signify that the circuit A communicates directly with circuit B (i.e., no intermediary) or communicates indirectly with circuit B (e.g., through one or more intermediaries).

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain arrangements require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other example arrangements, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

What is claimed is:

1. A footwear, comprising:

an outsole;

a cupsole coupled to the outsole, wherein the cupsole comprises an inner surface and a lateral wall that form a first receptacle, wherein the cupsole is composed of a first flexible material with a first durometer;

a midsole arranged within the first receptacle of the cupsole, wherein the midsole is composed of a second flexible material with a second durometer, the midsole comprises a top surface and a bottom surface, a portion of the lateral wall of the cupsole extends beyond the top surface of the midsole when the midsole is arranged within the first receptacle of the cupsole, wherein the portion of the lateral wall of the cupsole and the top surface of the midsole forms a second receptacle; and an upper, comprising a bottom plate coupled to the top surface of the midsole, wherein a bottom portion of the upper comprising the bottom plate of the upper is arranged within the second receptacle;

wherein a ratio between the first durometer and the second durometer is between 0.8 and 1.75, inclusive;

wherein the lateral wall has an equal height around a circumference of the inner surface;

wherein the midsole comprises a first portion that is located at a back of the cupsole and a second portion that is located at a front of the cupsole, the first portion having a thickness greater than the second portion.

2. The footwear of claim 1, wherein the first flexible material and the second flexible material are different flexible materials.

3. The footwear of claim 1, wherein the first durometer and the second durometer are different.

4. The footwear of claim 1, wherein the first receptacle extends to an entire length and width of the cupsole;

the midsole extends to an entire length and width of the first receptacle.

5. The footwear of claim 1, wherein the portion of the lateral wall of the cupsole that extends beyond the top surface of the midsole has a first thickness at the first portion of the midsole and a second thickness at the second portion of the midsole, and the first thickness is less than the second thickness.

6. The footwear of claim 1, wherein the midsole is coupled to the inner surface of the cupsole via an adhesive.

7. The footwear of claim 1, wherein the midsole is coupled to the inner surface and the lateral wall of the cupsole via an adhesive.

8. The footwear of claim 1, wherein the first flexible material comprises at least one of an elastomer or rubber.

9. The footwear of claim 1, wherein the first durometer is between 50 to 70 Shore A, inclusive.

10. The footwear of claim 1, wherein the second flexible material comprises at least one of a supercritical material, a gas-infused elastomer, or a foam.

11. The footwear of claim 1, wherein the second durometer is between 40 to 60 Asker C, inclusive.

12. The footwear of claim 1, wherein a width of the midsole is greater than a width of the upper.

13. The footwear of claim 1, wherein the cupsole has a first portion at a back of the outsole and a second portion at a front of the outsole, wherein the first portion and the second portion have a thickness difference.

14. The footwear of claim 13, wherein the thickness difference is about 8 mm.

15. The footwear of claim 1, wherein a portion of the upper is covered by the lateral wall forming the second receptacle.

16. The footwear of claim 1, wherein the midsole is coupled to the inner surface of the cupsole.

17. A system, comprising:

an outsole;

a cupsole having a first durometer, coupled to the outsole, wherein the cupsole forms a receptacle having a first end and a second end, the receptacle defined by a lateral wall and an inner surface of the cupsole;

a midsole having a second durometer, arranged within the receptacle of the cupsole, wherein the midsole is composed of a supercritical material, the midsole has a length extending between a first end of the midsole to the second end of the midsole, wherein the length of the midsole extends from the first end of the cupsole to the second end of the cupsole; and an upper coupled to the midsole and is arranged within the receptacle of the cupsole;

wherein a ratio between the first durometer and the second durometer is between 0.8 and 1.75, inclusive;

wherein the lateral wall has an equal height around a circumference of the inner surface;

wherein the first end of the midsole is located at a front of the receptacle and has a first thickness and the second end of the midsole is located at a back of the receptacle and has a second thickness and the first thickness is less than the second thickness.

18. The system of claim 17, wherein the supercritical material comprises a gas-infused elastomer.

19. The system of claim 17, wherein the first durometer and the second durometer are different.

20. A method, comprising:

providing an outsole;

providing a cupsole coupled to the outsole, wherein the cupsole comprises an inner surface and a lateral wall that form a first receptacle, wherein the cupsole is composed of a first flexible material with a first durometer;

providing a midsole within the first receptacle of the cupsole, wherein the midsole is composed of a second flexible material with a second durometer, the midsole comprises a top surface and a bottom surface, a portion of the lateral wall of the cupsole extends beyond the top surface of the midsole when the midsole is arranged within the first receptacle of the cupsole, wherein the portion of the lateral wall of the cupsole and the top surface of the midsole forms a second receptacle, wherein a ratio between the first durometer and the second durometer is between 0.8 and 1.75, inclusive; and coupling an upper to the top surface of the midsole, wherein the upper comprises a bottom plate, and a bottom portion of the upper comprising the bottom plate of the upper is arranged within the second receptacle;

wherein the lateral wall has an equal height around a circumference of the inner surface;

wherein the midsole comprises a first portion that is located at a back of the cupsole and a second portion that is located at a front of the cupsole, the first portion having a thickness greater than the second portion.

21. The method of claim 20, wherein the cupsole is molded via injection molding.

22. The method of claim 20, wherein the midsole is molded via gas-injected compression molding.

23. The method of claim 20, wherein the upper is assembled via patterning, cutting, stitching, and adhesion.

24. The method of claim 20, wherein the first durometer and the second durometer are different.

* * * * *